United States Patent [19]

Meyer

[11] 3,959,916

[45] June 1, 1976

[54] WHISTLING SCALING TOY

[75] Inventor: Paul Meyer, East Norwalk, Conn.

[73] Assignee: Lawrence Peska Associates, Inc., New York, N.Y. ; a part interest

[22] Filed: Oct. 17, 1974

[21] Appl. No.: 515,476

[52] U.S. Cl. ..... 46/74 D; 46/52; 46/180

[51] Int. Cl.[2] ..... A63H 33/18

[58] Field of Search ..... 46/74 D, 52, 180

[56] References Cited

UNITED STATES PATENTS

| | | | |
|---|---|---|---|
| 2,637,141 | 5/1953 | DeNisco | 46/52 |
| 2,835,073 | 5/1958 | Dame | 46/74 D UX |
| 3,359,678 | 12/1967 | Headrick | 46/74 D |
| 3,426,477 | 2/1969 | Novaco | 46/180 |
| 3,738,053 | 6/1973 | Camarota | 46/74 D |

*Primary Examiner*—Louis G. Mancene
*Assistant Examiner*—Robert F. Cutting
*Attorney, Agent, or Firm*—Jack D. Slobod

[57] ABSTRACT

An improvement to a circular toy intended to be scaled which provides a whistling sound. The whistling sound is produced by a plurality of generally Y-shaped passageways having flexible reeds disposed therein and which are exposed to air currents when the toy is scaled.

3 Claims, 5 Drawing Figures

WHISTLING SCALING TOY

BACKGROUND OF THE INVENTION

The circular toy known as the "frisbee" has been widely accepted and is well known for its scaling properties. The toy which is popularly identified as the "frisbee" is manufactured by the Wham-o Manufacturing Company and the word "frisbee" is their trade-mark. This and similar scaling toys have not heretofore utilized means for generating audible sounds such as whistling sounds and it is to this feature of such toys that the present invention is directed.

SUMMARY OF THE INVENTION

The invention provides a novel circular scaling toy apparatus which emits a sound when scaled in the conventional manner. The noise is generated by bifurcated passageways extending from the front to the rear of the toy. More particularly in the preferred embodiment a pair of passageways extending from the outer circumferential face of the toy join at approximately a ninety degree angle and connect at the intersection point to a single passageway extending to an opening at the rear or inner portion of the toy. Preferably the single passageway where the part of passageways meet has disposed therein a reed member which will vibrate upon the alternate passage of air through the alternate passageways. The reed ordinarily will be cantilevered from the common wall defining the pair of passageways.

DESCRIPTION OF THE PREFERRED EMBODIMENT

Figure 1:
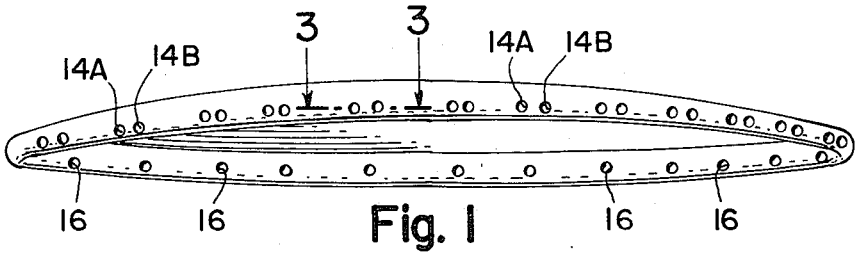
FIG. 1 is a side elevational view of a circular scaling toy shown with its peratrix axis tipped so that a portion of the underside of the toy is visible.
Figure 2:
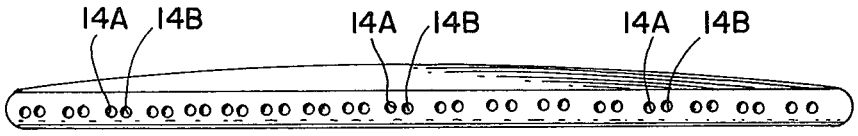
FIG. 2 is a side elevational view of a circular scaling toy with the geometric axis positioned vertically.
Figure 3:
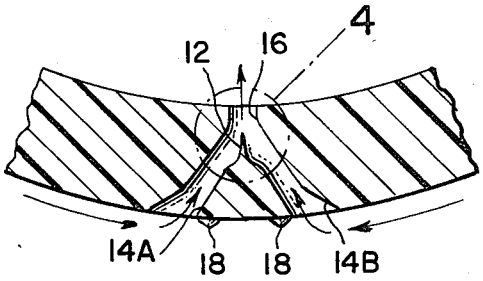
FIG. 3 is a broken away sectional view through the line 3—3 of FIG. 1 showing the angular relationship between the holes visible on the rear and faces of the toy.
Figure 4:
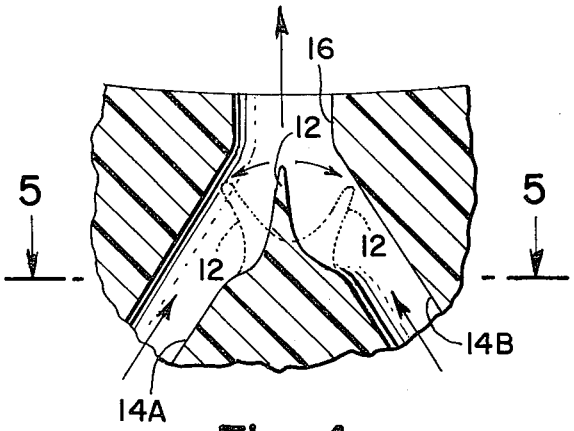
FIG. 4 is a view to enlarged scale of the section shown in FIG. 3.
Figure 5:
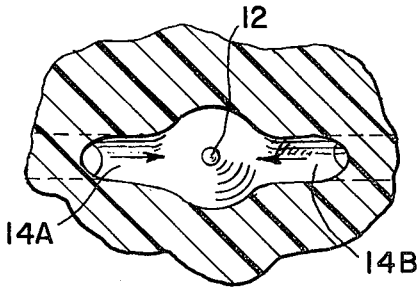
FIG. 5 is a sectional view taken through the line 5—5 of FIG. 4.

Referring now to the FIGs. 1 and 2 they are shown a plurality of pairs of passageways 14A, 14B extending from the outer circumferential or front face of the circular scaling toy. These passageways join and extend out the rear or inner face of the toy and define a passageway 16. Referring to FIG. 3, FIG. 4 and FIG. 5 there is shown the preferred embodiment wherein they juncture of the passageways identified by the numerals 14A and 14B meet to form a thin reed 12. The thin reed 12, is subject to vibration as the air is urged from the inlets 14A and 14B to the outlets 16. The air currents as the toy is rotated during the scaling motion tend to alternately be forced in one hole 14A and then in the other hole 14B. This causes the vibration of reed 12 as best shown in FIG. 4 wherein there is dotted line representation of the alternate positions of reed 12.

Commonly the entire "frisbee" including the noise emitting structure described herein should be made of plastic material and should be molded in a single step. In one form a deflector 18 which is upstanding from the surface of the periphery of the circular scaling toy is provided. This insures that there is an adequate supply of air delivered to the holes 14A and 14B to generate the required noise.

It will be understood that the embodiment described herein before is presented by way of example only and it may change as modifications can be made thereto without departing from the spirit of the invention or from the scope of the annexed claims.

Having thus described the invention, what is claimed as new is:

1. A scaling toy comprising: a generally circular disc having a flange depending generally perpendicularly about the periphery of said disc, and plural sound generation passageways extending generally radially through said flange in angularly spaced apart relationship, each of said passageways being generally of Y-shape communicating between a pair of angularly spaced apart openings on an outer side of said flange and an opening on an inner side of said flange.

2. The toy of claim 1 further comprising reed members disposed at junctions of the branches of said Y-shaped passageways.

3. The toy of claim 2 further comprising deflector means disposed adjacent each of said openings on the outer side of said flange.

* * * * *